United States Patent [19]

Bent et al.

[11] 4,056,353

[45] Nov. 1, 1977

[54] TEXTILE FINISHING

[76] Inventors: Alfred H. Bent, 2400 Kingman Drive; George J. Booth, 1102 Piper Road, Graylyn Crest, both of Wilmington, Del. 19803; Anthony Perregrino, 207 Taylor Road, Wilmington, Del. 19804

[21] Appl. No.: 670,941

[22] Filed: Mar. 26, 1976

[51] Int. Cl.[2] ..... D06P 7/00

[52] U.S. Cl. ..... 8/14; 8/2.5 R; 8/2.5 A; 57/1 R; 57/32; 57/35; 57/140 R; 57/165

[58] Field of Search ..... 89/14, 2.5 R, 2.5 A, 89/165; 57/35, 32, 1 R, 140 R

[56] References Cited

U.S. PATENT DOCUMENTS

| | | | |
|---|---|---|---|
| 2,823,092 | 2/1958 | Spencer | 8/14 |
| 3,619,103 | 11/1971 | Williams et al. | 8/14 |

*Primary Examiner*—John Kight, III

*Attorney, Agent, or Firm*—Robert Jacobs

[57] ABSTRACT

A new apparatus is disclosed for the rope-drying of dyed fabric resulting in a new fabric pattern having distinctive patterning. The process has three critical areas, particularly: the apparatus' ability to maintain a tension on the rope while it is being dried over contact dryers; the rope being formed into a very defined cylinder through an elongated tube; and the length of contact drying being sufficient to impart the migration of the dye stuff through the rope to form the applicable pattern.

9 Claims, 5 Drawing Figures

TEXTILE FINISHING

An apparatus is disclosed for the treatment of cloth by addition of a coloring finish in distinctive patterning. More particularly, the machine and apparatus disclosed enhance the finish of the cloth through a migration patterning in the drying process effected by placing the fabric in a proper rope form and drying it in proper contact with the drying surface in rope form.

It is an object of this invention to provide an apparatus for the migration dying of cloth.

It is another object of this invention to provide a process whereby cloth can be given a distinctive patterning by rope migration dying.

It is another object of this invention to provide a distinct cloth with a random patterning in multiple and single tonal shades.

Other objects of this invention will become apparent to those skilled in the art by reading the specification.

The basic apparatus of this invention is disclosed in FIGS. 1 through 5.

Figure 1:
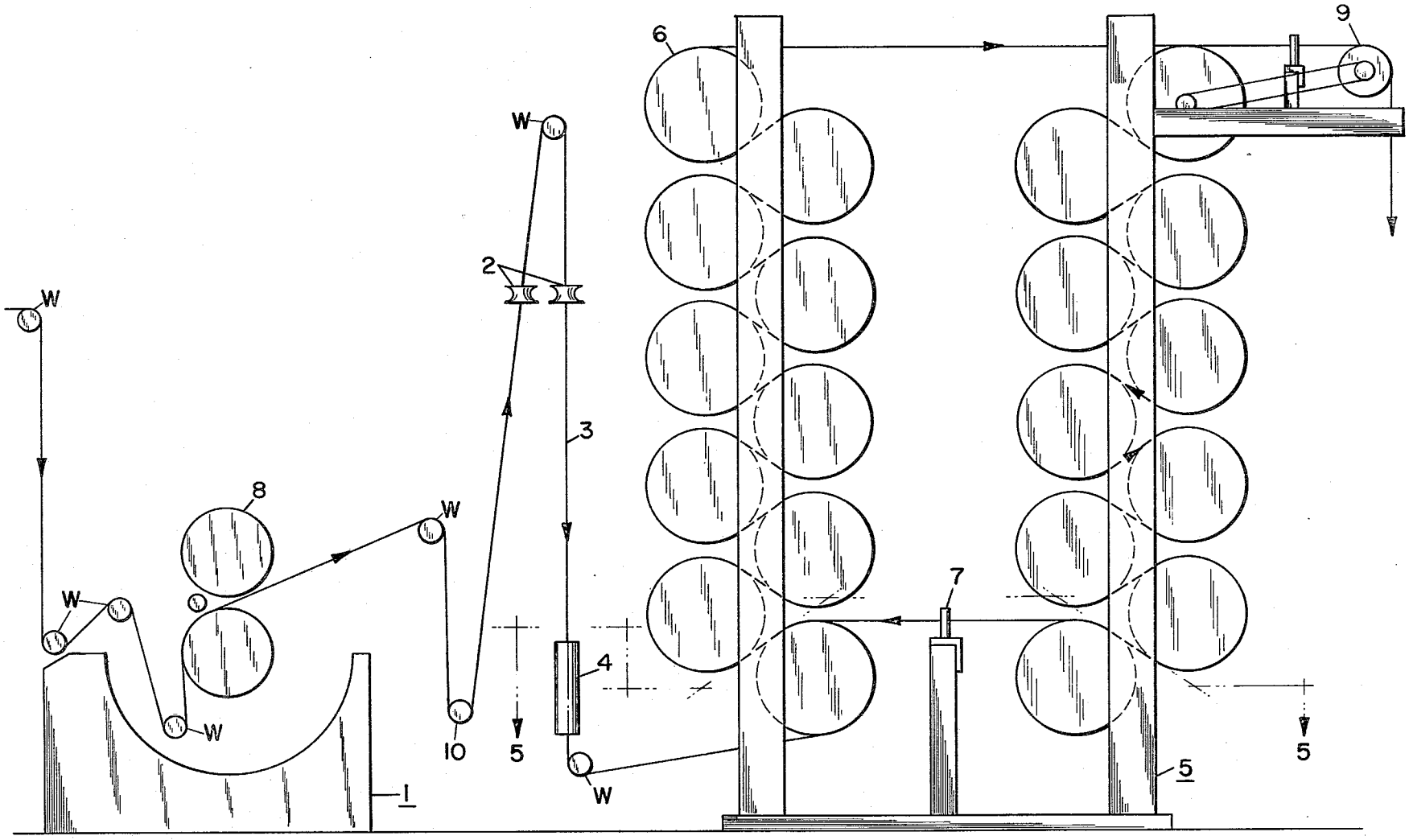
Figure 4:
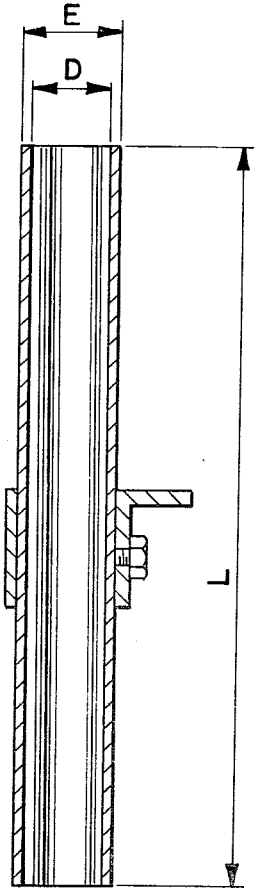
Figure 3:
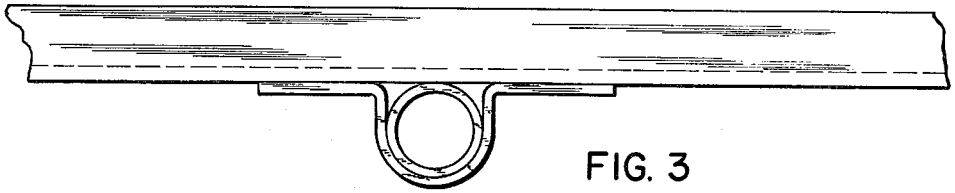
Figure 2:
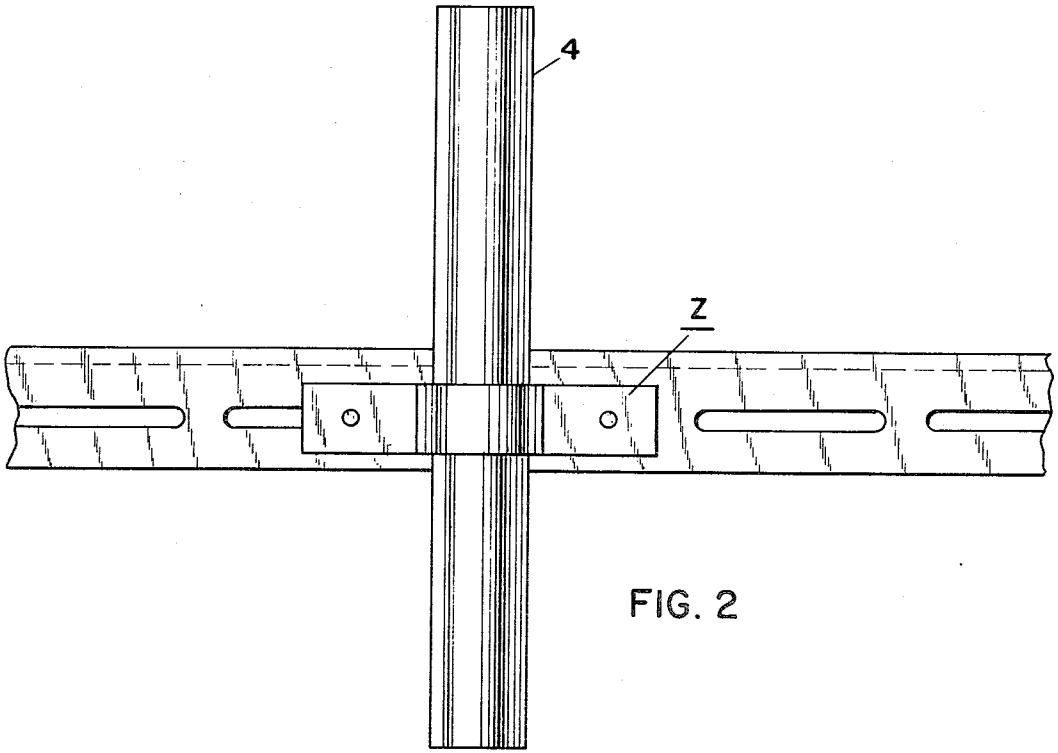
Figure 5:
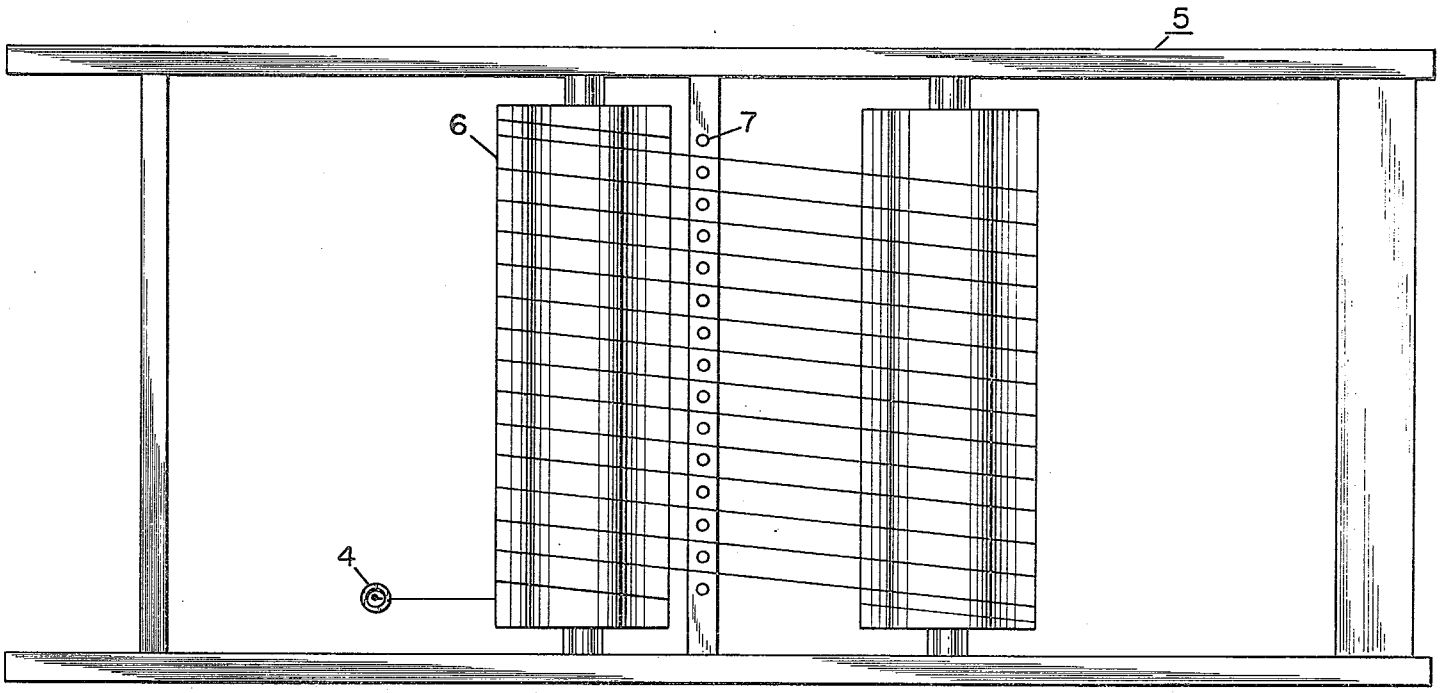

FIG. 1 is a schematic presentation of the apparatus and consists of a dye pad (Item 1) where the dye is applied, pot-eyes (Item 2) where the fabric is placed into the initial rope form; the fabric as a rope (Item 3); a tube-eye for further constricting the rope fabric (Item 4); a drum dryer (Item 5), the parts of which are particularly shown as: Item 6, drums; Item 7, a rake; and Item 9 is a drive mechanism, Item 8 is the pad of the dye pad and Item 10, a compensator roller. Items W are quide rollers for the cloth. FIG. 2 is a side view of the tube eye. Item Z is a bracket to holdthe tube eye in position. FIG. 3 is a top view of the tube eye. FIG. 4 is a detail of the tube-eye illustrated in FIG. 2 and is a side sectional view of the tube-eye indicating that it is L length long and has the internal and external diameters, called out. FIG. 5 is a detailed section of a portion of the drum dryer showing the cloth as it initially contacts the first drum and one of the drums in the opposite bank. A detail top view of the rake is also shown. This figure specifically shows that in this process, the rope is passed a multiple number of times across the drums of the drum dryer.

The apparatus as described has various critical features which enable it to be used in the process of migration dyeing. These features include a means for converting the sheet to a rope by the tube-eye which changes the fabric from a loose rope formed through the pot-eyes into a very tight rope with a smaller diameter as it comes out of the tube-eye. A means for contact drying. The drum dryer is one of many dryers which can be utilized in this process. It is illustrated because it is the preferred dryer. The characteristic of the drum dryer and all other dryers which can be utilized, such as an oven roller dryer would be that the rope fabric under tension is contacted with a hot surface. The drum dryer therefore enables one to place the rope in contact with the hot drum surface with steam being fed through the inside of the drum. The steam maintains the drum at a high temperature. The other necessary item is called out in FIGS. 1 and 5, particularly, and this is the rake for moving the rope fabric across the drum so as to insure multiple untangled courses across the drum giving greater contact time for the fixing of the dye and aiding in the migration of the color in this migration-dyeing.

The tube-eye general has an inner parameter of from about 1.25 to about 2.5 inches and preferably is about a 1.875 inch inner diameter. The length of the tube-eye, L, is generally about 6 to 24 inches long and preferably 16 to 20 inches long. Although the tube-eye may be longer than the length of 24 inches it is not a functional advantage.

A tension applying means. The compensating roller is the means by which proper tension is placed upon the rope so as to be assured that it flattens against the drying surface, in this instance the drum dryer, and has no loose pleats within the rope. This is a critical step of the process since a loosely pleated rope as it crosses the drying surface will defeat the migration of the dye and cause improperly finished dye-dried cloth. In the process the tension is controlled so the rope is taut and flat against the hot surface. Thus, the tension must be sufficient to fully flatten the rope against the drying surface with no air pockets or bubbles or the migration dyeing process will not work. The process of this invention consists of the following steps:

An open sheet of greige fabric or prepared fabric is contacted with a dye in a normal dye-pad apparatus shown as Item 1 in FIG. 1. The dyes that may be used will vary in accordance with the type of fabric being processed. Thus, a cotton cloth may be dyed using a vat type of dye such as Monolite Yellow PG Pds., Ponsol Golden Orange 3GPst and indenthorine Olive R Infa Dbl. Pst. [GAF Corp.]. Other dyes useable on cotton or cellulose fibres which need secondary curing or washing after the rope contact drying include: Sulfur Dyes such as Sodyesul liquid Yellow GLCF (by Sodyeco), Direct Dyes such as Direct Fast Orange ERL (by Atlantic Chemical Corp.), Reactive Dyes such as Procion Yellow MX6G (by ICI Chemical Corp.), and Napthol Dyes such as AS BN (by Atlantic Chemical Corp.). For synthetic fibres such as polyester or polyester cotton mixtures, Disperse Dyes may be used although they require a washing step and curing temperatures in excess of 380° F. Cloths such as polyester/cotton or polyester or other synthetic fabric will use resin-bonded pigments such as Sherdye resin bound pigments produced by the Textile Chemicals Division of Sherwin-Williams Chemicals and Kemsperse dyes produced by Sherwin-Williams Chemicals. The cloth is contacted with the pads and a pickup of about 65% is required to achieve the desired finish. The pickup may be as low as about 55% and as high as about 75% and still achieve the proper finishing of the process. Any dye level below 55% pickup will usually result in an insufficient application of color, although the process will still be effected with a less desirable final product. Anything greater than 75% pickup should be avoided because of the extra dye and problems inherent with waste of dye materials. In any case, although the above is the preferred range in which the process should be worked, working outside of this range will still produce fabric within the meaning of this process.

Pickup is defined as a percentage of the weight of the initial cloth added as dye, that is, if the cloth weighs 100 pounds, a pickup of 65% would mean that 100 pounds of cloth would weigh 165 pounds including dye.

After passing through the dye pads, the fabric is fed over stationary type rollers, Item W, FIG. 1, through pot-eyes to place it into a loose rope form. The rope is then fed over the compensating roller through an additional pot-eye and then through the tube eye to give a tight constricted rope. The compensating roller puts on a proper tension so that when the rope contracts the drums of the drum dryer, it is forced into a totally flattened position without any loose folds or air bubbles. Therefore, there are no bubbles and there is total contact between all layers of the rope fabric as it is flat against the hot dryer surface. The tight concentric rope is thus spread evenly across a portion of the drum dryer and flattened until all layers are in total contact. The rope is then fed over all of the drums of the drum dryer and back through the rake shown in FIG. 1 and FIG. 5, and fed through a multiple number of times as indicated in FIG. 5. The rope then is exited through the drive mechanism and collected in any number of ways. In addition to the tight concentric rope the rope may be twisted in a spiral prior to the contact drying and will exhibit similar patterns with a shorter random stripe.

Among the means of collecting the rope fabric after being dried are: the rolling of the fabric on a roller after it passes over Item 9 in FIG. 1; the collection of the fabric in a bin by allowing it to loosely fall into the bin; or the collection of the fabric by reopening the rope into sheet form and folding the resultant sheet goods. None of the means nor methods of collecting the migration-dyed fabric after passing the final drying step are necessarily incorporated within this invention and are not deemed to be a necessary portion of the invention other than the fact that naturally, the novel fabric must be collected after the processing steps are finished.

As the process is outlined above, there are various parameters which have been determined on the equipment illustrated in FIG. 1 which enable one to obtain the desired result. Thus the number of drums, Item 6 in FIG. 1, equals 20 and the average circumference of the drums is 72 inches, a weight is added to Item 10, the compensating roller, equal to approximately 89 lbs. This weight may vary between approximately 80 and 100 lbs. and give adequate tension; however, it is preferable to have it about 89 lbs. With this weight on the compensating roller, the fabric rope is usually processed at a rate between about 29 and about 45 yards per minute, linear velocity, dependent to a great extent on the weight of the fabric utilized. The speed may go as high as 80 yards a minute for light fabric so long as the tension placed by the speed and weight of the compensating roller does not cause, or tend to cause, ripping damage to the fabric and as low as 20 yards a minute. In general, a heavy weight fabric will be described as a 1 Yard fabric which is defined as fabric where one square yard weighs a pound. Such a fabric will run at a linear speed of 33 yards a minute and at a compensating roller weight as indicated above on or through a dryer with 20 drums with the average circumferences indicated at 72 inches. A light fabric is considered a 4 Yard fabric, i.e. 4 square yards weighing a pound. The rope makes about 14 separate passes through the drum-dryer prior to exiting the machine over Item 9 of FIG. 1. Usually, the drums are heated with steam to temperatures about 260° F, to about 300° F. dependent on the steam pressure utilized.

The contact time when the rope fabric will be in intimate contact with the drying surface and when each layer of the flattened rope is intimately contacting the previous layer will vary according to the weight of the fabric. In general, it will not be below about 5 minutes of contact nor above about 60 minutes. The lower parameter is more critical since sufficient time must be allowed for complete migration of the dye or the process will not accomplish the migration of the dye. The dryer time may be extended as it will not interfere with the final product but will merely interfere with the rapid processing of the fabric. For fabrics of about 1-Yard weight contact time should be from about 18 to about 40 minutes. For fabrics of 2 to 3 Yard weight, it should be from about 13 to about 30 minutes and for fabric of 4 to 5 Yard weight, contact time is about 9 to 25 minutes.

Where drums of a circumference of 95 inches are utilized, it has been found that lower compensating roller weights, as low as 30 to 50 lbs., can be utilized at speeds of from 18 to 45 yards per minute. In dryers with 95 inch diameter drums, only 8 drums are utilized. Temperatures during processing in all types of dryers, will be from about 220° F. to 450° F. Illustrative of the utilization of the equipment and the process are the following examples:

1. A 1 Yard weight fabric is passed through a dye pad containing blue Sherdye, produced by the Sherwin Williams Company, at a 65% wet pickup. The fabric is moved through the dye pad at a rate of 33 linear yards per minute. The fabric is then passed over a stationary roller; under a compensating roller of 89 lbs. in weight; through a pot-eye and over another stationary roller and through a second pot-eye forming a loose rope. The loose rope is then fed through a tube-eye which is 18 inches long and one and a quarter inches in diameter. The tight rope exiting from said tube-eye is passed under a stationary roller and then through a drum dryer containing 20 drums. Each drum is heated by steam at 35 pounds per square inch (p.s.i.g.) so that the external temperature of said drums is 280° F. The circumference of said drums is 72 inches. The tight rope fabric is fed through this system 14 times before it exits the drying mechanism. The resultant fabric has striped tones of blue resulting from the migration of dye during the drying processing step.

2. The fabric of example 1 is then opened into sheet form and fed through a second dye pad containing orange Sherdye and passed over a stationary roller and under the compensating roller of 90 lbs., formed into a rope form as it passes over the compensating roller and passed through a pot-eye over a stationary roller to a second pot-eye, then through a tube-eye and then on to a drum dryer containing 8 drums of 95 inches in circumference. Said rope passes through the series of 8 drums, 14 times. The linear yard movement of the fabric is 41 yards per minute and the temperature of the surface of the drum is 275° F. heated by 30 lbs. per square inch (p.s.i.g.) steam. After passing through the drying step and fixing the dye, the fabric is opened into sheet form and collected on rolls. The resultant fabric has multiple hues and contains color patterns across its width. The migration of the color through the fabric, dependent on the pleating and tightness of the fabric during the processing step, is obvious to those in the arts.

3.A fabric of 3 yards-weight is fed through a dye pad in sheet form and contacted with a red dye of Kemsperse at a 65% wet pickup. The material is formed into a rope by passing under the compensating roller with forty pounds weight, through a pot-eye, over a stationary roller, through a second pot-eye and then through a constricting tube-eye to form a tight rope fabric. The dye wet fabric in rope form is then passed over a drum dryer containing eight drums of 98 inches in circumference, heated to 280° F. surface temperature, with 30 lbs per square inch (p.s.i.g.) steam. The fabric is passed through the system at 30 yards per minute linear speed. The fabric is then collected in rope form and opened to a sheet. This sheet is passed through a second dye pad containing yellow dye to a 65 weight percent wet pickup. The wet fabric is then placed in rope form and then passed over the compensating roller of 42 lbs. in weight and processed through a drum-dryer containing 8 drums of 95 inch circumference passing over each drum 14 times and exiting and being opened into sheet form. The linear velocity is 41 yards per minute. The temperature of the drums is 275° F. The fabric was under a sufficient tension to flatten the rope without bubbles on all drums. The fabric is then opened into sheet form and passed through a third dye pad at 65% wet pickup with green dye of the Sherdye formulation, passed through a compensating roller of 89 lbs. through a pair of pot eyes and stationary rollers to a tube-eye, thus forming a tight concentric rope. This rope under the tension applied is flattened against the drums of the drum dryers, which are 72 inches in circumference. The rope passed each of the 20 drums in the system 14 times prior to exiting this system and being collected as the final fabric in open sheet on a roll.

The above examples give the preferred manner of using the equipment as shown in FIG. 1. Naturally, if an oven tension dryer is utilized, with a hot roller surface, the length of the dryer can be regulated so as to give the same contact time as the drum dryer described in the examples. In addition, although up to 3 separate color applications are illustrated as many as 6 applications of various color dyes can also be utilized. If one goes beyond six applications, the pattern is lost. The addition of white pigment by this method can give a frosted effect to the patterns. The resulting fabric shows a novel color pattern which is distinctly different than any pattern heretofore known. The critical portion of the equipment and process is the concept of drying in a rope form to enhance the migration and variation of the color within the fabric.

The resulting fabric is unique in that because of its random patterning there are no problems in seam matching when the fabric is utilized in yard goods, nor are there any problems in variation from lot to lot due to the fact that the variation between any two consecutive yards of material is too great to notice a variation in color lot. Thus, this system of drying for these distinctive patterns solves the age old problem of dye variations from lot to lot since the color variation between sheets is immaterial.

Having thus described their invention, applicants now claim the following:

1. An apparatus for migration-dyeing of fabrics which comprises a means for applying dye on an open sheet of fabric so that the fabric can attain a pick-up of from about 55 weight percent up to about 75 weight percent; a means for converting the sheet into a tight fabric rope wherein an integral part of said means is a tube-eye; placing tension on the tight fabric rope; a contact drying means for the tight fabric rope to pass over so that the rope intimately contacts the hot surface of the dryer under such tension that the tight rope fabric is flattened against the drying surface, forcing all layers into intimate contact.

2. An apparatus according to claim 1 wherein the means for converting the open sheet of fabric into a tight fabric rope consists of poteyes, in addition to the tube-eye, and the means for applying the dye is a dye pad.

3. Apparatus according to claim 1 wherein said contact drying means is either a drum dryer or an oven roller dryer.

4. A process for migration-dyeing which comprises applying dye to a fabric in open sheet form, forming the dye containing fabric into a tight tubular rope form by use of a tube-eye, then the tight rope fabric is passed through a contact dryer at temperatures equal to a fixing temperature of the dye used under tension so that the rope is flattened from a tubular rope form into a flat rope form wherein each layer within the rope is in intimate contact with the layers on either side and the flat rope is in intimate contact with the contact dryers surface; the contact time on the contact dryers surface will vary from about 5 minutes to about 60 minutes.

5. A process according to claim 4 wherein said rope is twisted into spiral before it is passed through the contact dryer.

6. A process according to claim 4 wherein the contact time for one yard fabrics is about 18 to about 40 minutes, for 2 and 3 yard fabrics is about 13 to 30 minutes and for 4 and 5 yard fabrics about 9 to about 25 minutes.

7. Cellulosic fabric processed in accordance with the process of claim 4.

8. Blends of cellulosic/man-made fibers fabric processed in accordance with the process of claim 4.

9. Man-made fibers fabric processed in accordance with the process of claim 4.

* * * * *